US010246228B2

(12) United States Patent
Meyers et al.

(10) Patent No.: US 10,246,228 B2
(45) **Date of Patent: *Apr. 2, 2019**

(54) LIQUID DISPENSING CONTAINER WITH MULTI-POSITION VALVE AND STRAW

(71) Applicant: RUNWAY BLUE, LLC, Alpine, UT (US)

(72) Inventors: David O. Meyers, East Layton, UT (US); Nathan K. Hirst, Spanish Fork, UT (US)

(73) Assignee: Runway Blue, LLC, Alpine, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/624,352

(22) Filed: Jun. 15, 2017

(65) Prior Publication Data

US 2017/0283134 A1 Oct. 5, 2017

Related U.S. Application Data

(63) Continuation of application No. 14/592,267, filed on Jan. 8, 2015, now Pat. No. 9,694,953.

(51) Int. Cl.
*A47G 19/22* (2006.01)
*B65D 47/24* (2006.01)
(Continued)

(52) U.S. Cl.
CPC ..... *B65D 47/247* (2013.01); *A47G 19/2266* (2013.01); *A47G 19/2288* (2013.01);
(Continued)

(58) Field of Classification Search
CPC ..... A47F 3/16; A47G 19/22; A47G 19/2266; A47G 19/2288; B65D 24/40; B65D 25/42; B65D 25/44; B65D 47/24; B65D 47/28; B65D 47/06; B65D 47/247; B65D 81/3283
(Continued)

(56) References Cited

U.S. PATENT DOCUMENTS 3,937,364 A 2/1976 Wright
4,286,636 A 9/1981 Credle
(Continued)

FOREIGN PATENT DOCUMENTS

CN 101730492 A 6/2010
CN 101730651 A 6/2010
(Continued)

OTHER PUBLICATIONS

International Search Report and Written Opinion dated Jan. 6, 2016 as received in Application No. PCT/US2015/056493, 13 pgs.
(Continued)

*Primary Examiner* — J. Gregory Pickett
*Assistant Examiner* — Niki M Eloshway
(74) *Attorney, Agent, or Firm* — Maschoff Brennan; Paul G. Johnson

(57) ABSTRACT

A liquid dispensing container may include a body, lid, valve assembly, and straw. The valve assembly may be movable between a first position to allow contents to be discharged by inverting and/or squeezing the container, and a second position to allow the contents to be discharged by sucking and/or squeezing through a straw.

20 Claims, 8 Drawing Sheets

(51) Int. Cl.
*B65D 47/06* (2006.01)
*B65D 81/32* (2006.01)
*B65D 47/28* (2006.01)
*B65D 25/50* (2006.01)

(52) U.S. Cl.
CPC ..... *B65D 47/06* (2013.01); *B65D 47/283* (2013.01); *B65D 81/3283* (2013.01)

(58) Field of Classification Search
USPC ..... 220/705, 708, 707, 709, 714, 717; 215/18, 229, 11.4, 311, 388; 222/566
See application file for complete search history.

(56) References Cited

U.S. PATENT DOCUMENTS 4,768,667 A 9/1988 Magnusson
D308,828 S 6/1990 Magnusson
4,976,364 A 12/1990 Solomon
D339,503 S 9/1993 Callaway
5,326,006 A 7/1994 Giard, Jr.
D350,672 S 9/1994 Egger et al.
5,545,315 A 8/1996 Lonneman
D391,448 S 3/1998 Winer et al.
D398,478 S 9/1998 Spencer
5,984,141 A * 11/1999 Gibler ..... A47J 41/0027 206/219
6,135,311 A 10/2000 Panec et al.
6,971,551 B2 * 12/2005 Widgery ..... A47G 19/2266 222/129
7,204,382 B2 4/2007 Cezeaux
D586,183 S 2/2009 Junkel
D600,973 S 9/2009 Lane
D608,204 S 1/2010 Caroen et al.
D608,640 S 1/2010 Carreno
D609,969 S 2/2010 McKinney
7,775,394 B2 8/2010 Naesje
D626,409 S 11/2010 Hooley
8,051,674 B2 11/2011 Roth et al.
D655,569 S 3/2012 Lipson
D657,194 S 4/2012 McIntire et al.
D660,081 S 5/2012 Gilbert
8,272,525 B1 9/2012 La Torre et al.
D675,865 S 2/2013 Wahl
8,505,783 B2 * 8/2013 Gill ..... A45F 3/20 215/388
8,505,793 B2 8/2013 Foley
D689,331 S 9/2013 Staton
D690,162 S 9/2013 Staton
D690,556 S 10/2013 Boroski
D691,420 S 10/2013 McIntire
8,695,836 B1 * 4/2014 Gregory ..... B65D 23/106 215/387
D707,492 S 6/2014 George
D724,895 S 3/2015 Kawase et al.
D725,436 S 3/2015 Miller
D725,967 S 4/2015 Peng
D736,562 S 8/2015 Green et al.
D760,027 S 6/2016 Meyers et al.
9,498,086 B2 * 11/2016 Waggoner ..... A47J 41/0083
2004/0188280 A1 * 9/2004 Young ..... A47G 21/183 206/219
2005/0115966 A1 6/2005 Leoncavallo et al.
2005/0121405 A1 6/2005 Drajan
2006/0283896 A1 12/2006 Kasting
2010/0108700 A1 5/2010 Scott
2010/0270337 A1 10/2010 Green et al.
2011/0248054 A1 10/2011 Darby
2012/0012617 A1 1/2012 Gill et al.
2013/0214012 A1 8/2013 Pils et al.
2014/0263476 A1 9/2014 Blain et al.
2014/0319183 A1 * 10/2014 Choi ..... A47G 19/2266 222/465.1
2015/0164254 A1 6/2015 Niedens
2015/0210443 A1 7/2015 Sarson

FOREIGN PATENT DOCUMENTS

CN 102099251 A 6/2011
WO 2005032948 A2 4/2005
WO 2007/069257 A2 6/2007

OTHER PUBLICATIONS

First Office Action from Chinese State Intellectual Property Office for Application No. 2016100061521, dated Jun. 1, 2017, 40 pgs.
Extended European Search Report dated Aug. 24, 2018 as received in Application No. 15877288.9 (8 pgs).
Examination Report issued in Australian Application No. 2015375450 dated Sep. 4, 2018, 3pgs.

* cited by examiner

LIQUID DISPENSING CONTAINER WITH MULTI-POSITION VALVE AND STRAW

CROSS-REFERENCE TO RELATED APPLICATION

This application is a continuation of U.S. application Ser. No. 14/592,267, filed Jan. 8, 2015, which application is incorporated herein by reference.

BACKGROUND

Field of the Invention

This application is generally directed towards a liquid dispensing container and, more specifically, to a liquid dispensing container that may include a multi-position valve and/or a straw.

Description of Related Art

Conventional containers may hold a variety of different types of liquids and fluids such as water, beverages, drinks, juices and the like. Conventional containers can also hold various items such as energy drinks, protein drinks, shakes, foodstuffs, dressings, sauces, and liquid meal replacements.

These known beverage containers may be used in a wide variety of environments such as at home, office, gym or health club, and while traveling. Known beverage containers may also be used during activities such as exercising, driving a car, or riding in an automobile, bus, train, or airplane.

In some situations, a squeeze-type container, in which the contents of the container are dispensed by inverting and squeezing the container, may be desired. A squeeze-type container may be useful before, during or after active participation in a sports activity, such as bicycling, climbing, jogging, or hiking. Known squeeze-type containers may be designed to be used under stressful conditions and with just enough flexibility to allow a beverage to be "squirted out," while maintaining their structural integrity for grasping or holding by the user and retaining generally the same shape. Known squeeze-type containers may also be designed to be opened and re-closed with the user's mouth so as to allow drinking while minimally interfering with an ongoing activity.

These known squeeze-type containers may be referred to as water bottles, and many water bottles are reusable and refillable. Water bottles are commonly used for hydration, such as by cyclists, and traditional water bottles commonly include a body, a cap, and a valve that is movable relative to the cap between open and closed positions. In the open position, liquid can be dispensed from the bottle and, in the closed position, liquid is inhibited from being dispensed from the bottle.

Water bottle valves are frequently in the form of poppet-style valves that include a poppet that can be moved between open and closed positions. A poppet-style valve typically moves perpendicularly relative to the cap to allow fluid to be dispensed from the water bottle or to seal the opening in the cap. In particular, the poppet-style valve may be moved away from the cap to open a traditional water bottle and allow fluid to flow through the valve. When the poppet-style valve is moved towards or contacts the cap, the valve may be closed and fluid may not flow through the valve. Fluid is normally dispensed from a conventional water bottle by inverting the bottle and allowing the contents to flow through the valve in the open position. In order to expedite water flow through the valve, the bottle may be formed from a lightweight and deformable plastic material, and the water may be more quickly dispensed by squeezing the bottle.

BRIEF SUMMARY

In some situations, squeeze-type containers requiring inversion of the bottle for dispensing the liquid can be undesirable. For example, a bicyclist or motorist must tilt his or her head back and divert his or her attention from the road at least momentarily in order to consume the contents of a squeeze-type container. Also, a squeeze-type container, with its inherent requirement of container elevation, can be undesired in some situations. For example, in circumstances where height or space may be limited, or where concealment is desired, it may be difficult or undesirable to invert the bottle and/or position the person's head for drinking from a conventional squeeze-type container. Further, during more leisurely or slow-paced activities, such as walking, a person may not want to tilt his or her head back and continually invert and squeeze a container in order to consume the contents of the container.

In such situations, a container equipped with a straw may be useful. Conventional containers, however, often require removal of the cap and insertion of the straw into the opening into the container. This process may be time-consuming, require physical dexterity, and many times the straw may be lost before it is used. In addition, many straw-equipped containers may allow the contents to spill or leak through the opening and/or the straw, especially when the container is full. Also, some known straw-equipped containers only allow the contents of the container to be consumed through the straw, unless the straw is physically removed from the container. Physical removal of the straw, however, may undesirably take a significant amount of time. Additionally, it may be especially difficult to consume all or the last contents of many straw-equipped containers, which may waste some of the contents and the remaining contents may disadvantageously leak from the container. Further, fast, high-volume consumption of the liquid, which may be desired during or after sports activities, can be difficult, especially when the contents of the container are low.

A need therefore exists for a liquid dispensing container that eliminates the above-described disadvantages and problems.

One aspect is a container that may be sized and configured to hold one or more liquids. For example, the container may hold one or more liquids, beverages, drinks, juices, vitamin enhanced beverages, energy drinks, thirst-quenchers, flavored waters, and the like. The container may also hold solutions and/or solids such as energy drinks, protein drinks, shakes, liquid meal replacements, etc. In addition, the container may be a shaker cup and the contents can be shaken, stirred, mixed and/or blended as desired, such as supplements, vitamins, protein powders, etc. This may allow the container to be used to create protein drinks, shakes, smoothies, dressings, sauces, etc. The container could also be a water bottle in which water and other types of fluids can be transported and/or consumed. The container could further include foodstuffs such as fruits, vegetables, soups, and the like.

Advantageously, the container may be reusable and refillable, which may allow the container to be used for many different purposes over an extended period of time. The container may also be easily carried and portable. For example, the container may be conveniently held in one-hand by the user. Additionally, the container may be insulated to help keep the contents at a desired temperature, such as at a lower or higher temperature. In addition, the container may include a small number of parts and components, which may facilitate manufacturing and assembly. Further, the container may be easily disassembled and cleaned. As discussed in greater detail below, the container may include a lid or cap that allows the container to be easily filled from various sources.

The container may also include a handle and/or grip, which may minimize slipping of the hand and/or fingers. The handle and/or grip may also facilitate carrying of the container. For instance, the container may include one or more ribs, projections, textured surfaces, and the like. In addition, the container may be sized and configured to be disposed in a cup holder, bicycling water bottle cage, and the like, which may facilitate transportation, storage, and/or use of the container.

Another aspect is a container that may be at least partially constructed of a deformable, squeezable material, such as plastic or other materials with suitable characteristics and properties. For example, the container may be constructed from a flexible material that allows the container to be squeezed and then the container may resiliently return to at least generally the same shape and configuration. The container may have a relatively large opening to allow the container to be easily filled, cleaned, and/or washed. One of ordinary skill in the art will appreciate, after reviewing this disclosure, that the container could have other shapes, sizes, configurations and/or arrangements depending, for example, upon the intended use of the container.

Still another aspect is a container that may include a straw and the straw may allow the contents of the container to be sipped or sucked through the straw. The straw may also allow a user to drink from the container while the container is in a generally upright position. Significantly, the straw may allow a user to drink from the container when the container is disposed in a generally vertical position. For example, in one exemplary embodiment, the generally vertical position may include whenever the container is within a 90° angle of vertical. That is, the straw may allow the user to drink from the container when the container is disposed between a generally upright to a generally horizontal position. In another exemplary embodiment, the user may drink from the straw when an upper end of the straw is disposed above the lower end of the straw. For example, lower end of the straw may be disposed at least proximate the lower inner surface of the container and the upper end of the straw may be disposed at least proximate the opening in the lid. The user may easily drink through the straw when the container is positioned such that the upper end of the straw, which may be located at least proximate the valve assembly, is above the lower end of the straw.

Still yet another aspect is a container that may include a valve assembly for dispensing the contents of the container through an opening in a lid. The valve assembly may at least partially extend through and/or be aligned with an opening in the lid. The opening may be located at or at least proximate the center of the lid, toward the periphery or outer edge of the lid, or other desired portion of the lid. The valve assembly may include a gasket, washer, sealing ring and/or liner to help seal the opening when the valve is in the closed position. The valve assembly may create a liquid and/or air-tight seal, which may prevent the contents of the container from leaking or spilling.

Advantageously, the valve assembly may increase the potential uses and functionality of the container. For example, the valve assembly may include a valve that is movable between a first open position, which may allow the contents to be discharged by inverting and/or squeezing the container, and a second open position, which may allow the contents to be discharged by sucking through the straw and/or squeezing the container so that fluids flow through the straw. Thus, increased flexibility may be provided in that the user may drink from the container by "squirting" or using the container as a conventional water bottle when the valve assembly is in the first open position, or by sucking or squeezing through a straw when the valve assembly is in the second open position. The valve may also be disposed in a third or closed position, which may prevent fluid flow through the valve.

Preferably, a force may be required to move the valve between the various positions. For example, when the valve is in the first open position, a force or other intentional act may be required to move the valve from the first open position to the second open position. Similarly, when the valve is in a closed position, a force or other intentional act may be required to open the valve, which may help prevent unintended opening of the valve. Further, a force or intentional act may be required to move the valve from the first or second open positions to the closed position, which may facilitate faster consumption of the liquids within the container.

The user may move the valve between the three positions by pulling a nozzle upward using his or her fingers or mouth. For example, the valve may be disposed in the closed position and the nozzle may be pulled upwardly or away from the container and into the first open position. In the first open position, fluid may flow from the container and through the nozzle by squirting and/or inverting the bottle, which may allow the container to be used in a manner similar to a conventional water bottle. In this position, fluid may flow directly through the valve assembly and not through the straw. The nozzle may also be pulled upwardly or away from the container and into the second open position, which may allow the user to drink through the straw, such as when the container in the generally upright position. The valve assembly may be moved to the closed position by depressing the nozzle in a downward direction and/or towards the container. In view of this disclosure, one of ordinary skill in the art will understand that the valve may move between various positions depending, for example, upon the intended use of the container. It will also be understood the different positions could have different functions or purposes. For example, when the valve is in the first open position, the user may drink from the straw or fluid may be squeezed out of the container through the straw and, when the valve is in the second position, fluid may flow through the opening by squeezing and/or inverting the bottle. It will further be appreciated that the valve assembly may be closed when the nozzle is in any desired position relative to the bottle, such as in an intermediate or extended position.

A further aspect is a container that may include a valve assembly with a nozzle, spout, straw cap, and valve housing. The nozzle, spout, straw cap, and valve housing may be coupled or joined by, for example, fitting, snapping, threading, connecting, attaching, or fastening. When the nozzle and spout are in a first position, the contents of the container may be discharged by inverting and/or squirting fluid from the container. When the nozzle and spout are in a second position, the contents of the container may be discharged by sucking and/or squeezing fluid through the straw. The straw cap and valve housing may remain stationary or fixed relative to the lid when the nozzle and spout are moved relative to the lid. One or more gaskets, washers, sealing rings, liners and the like may be used in connection with the nozzle, spout, straw cap and/or valve housing to help seal the valve assembly and/or help prevent fluids from leaking from the container.

A still further aspect is a container that may include a lid. The lid may be coupled or connected to the container by a threaded connection and that may allow the lid to be quickly secured to the container in a straightforward manner. The lid may also be selectively or permanently attached to the container. The lid may also include a gasket, washer, sealing ring or liner to help seal the opening of the container. The lid may be constructed from plastic, metal, a combination or plastic and metal, or other materials with suitable characteristics and properties. The lid may also include an air valve. The air valve may be a one-way valve designed to decrease or relieve the pressure that can be created in a tightly sealed container when sucking through a straw. The air valve, for example, may be created with an access hole in the lid above a slit valve in the lid gasket. In view of this disclosure, one of ordinary skill in the art will appreciate that the lid could be larger or smaller, with any suitable number of openings or apertures of varying sizes, depending, for example, upon the intended use of the container.

Advantageously, the container may be constructed from relatively few parts that may be quickly and efficiently manufactured. For instance, the container may include a body for containing the liquid, such as a bottle, reservoir or the like. The body may include an opening and a lid, cap or closure may be used to at least partially seal the opening. The container may also include a valve assembly that controls fluid flow through an opening in the lid. It will be appreciated that the container, body, valve assembly, and lid can include any number of parts and components depending, for example, upon the intended use of the container.

A further aspect is a liquid dispensing container that may include a body; a lid attached to the body; and a valve assembly movable between a closed position, a first open position and a second open position. The valve assembly may include a nozzle and the nozzle may be movable within an opening in the lid. The nozzle may be movable relative to the lid between the closed position, the first open position and the second open position. The valve assembly may also include a conduit coupled to the nozzle and the conduit may include a first opening that allows fluid flow into an interior portion of the conduit and a second opening that allows fluid flow into the interior portion of the conduit. In addition, the valve assembly may include a straw connector coupled to the lid; a straw cap at least partially disposed within the straw connector; and a straw coupled to the straw connector. When the valve assembly is in the closed position, the valve assembly may prevent fluid flow through the nozzle. When the valve assembly is in the first open position, a first fluid passageway may allow fluid to flow through the first opening in the conduit and the nozzle. When the valve assembly is in the second open position, a second fluid passageway may allow fluid to flow through the straw, the straw cap, the second opening in the conduit and the nozzle.

Another further aspect is a liquid dispensing container that, when the valve assembly is in the closed position, may include the nozzle disposed in the closed position; when the valve assembly is in the first open position, the nozzle may be disposed in the first open position; and when the valve assembly is in the second open position, the nozzle may be disposed in the second open position. In addition, when the valve assembly is in the closed position, fluid may not be able to flow through the first passageway or the second passageway; when the valve assembly is in the first open position, fluid may not be able to flow through the second passageway; and when the valve assembly is in the second open position, fluid may not be able to flow through the first passageway. Additionally, the positioning of the valve assembly may determine whether fluid can flow through the first passageway and/or the second passageway. Also, no fluid may flow through the straw or straw cap when the valve assembly is in the first open position; and fluid may flow through the straw and the straw cap when the valve assembly is in the second open position. Further, fluid in the body of the container may flow through the straw, the straw cap, the second opening in the conduit and the nozzle when the valve assembly is in the second open position; and fluid may not flow through the first opening in the conduit when the valve assembly is in the second open position. Finally, when the valve assembly is in the first open position, fluid can be discharged from the body by inverting and sucking on the nozzle and/or squeezing the container; and when the valve assembly is in the second open position, the fluid can be discharged from the body by sucking and/or squeezing through a straw.

Still another further aspect is a liquid dispensing container that may include a body; a lid attached to the body; and a valve assembly movable between a closed position, a first open position and a second open position. When the valve assembly is in the closed position, the valve assembly may prevent fluid from being discharged from the body; when the valve assembly is in the first open position, a first fluid passageway may allow a fluid to be discharged from the body by inverting and/or squeezing the container; and when the valve assembly is in the second open position, a second fluid passageway may allow the fluid to be discharged from the body by sucking and/or squeezing through a straw. In addition, when the valve assembly is in the closed position, the fluid may not be able to flow through the first passageway or the second passageway; when the valve assembly is in the first open position, the fluid may not be able to flow through the second passageway; and when the valve assembly is in the second open position, the fluid may not be able to flow through the first passageway.

These and other aspects, features, and advantages of the present invention will become more fully apparent from the following brief description of the drawings, the drawings, the detailed description of preferred embodiments, and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships, and configurations of the invention, the drawings are not intended to limit the scope of the claimed invention. The invention will be described and explained with additional specificity and detail through the use of the accompanying drawings in which:

DETAILED DESCRIPTION

The present invention is generally directed towards liquid dispensing containers. The principles of the present invention, however, are not limited to liquid dispensing containers. It will be understood that, in light of the present disclosure, the liquid dispensing containers disclosed herein may have a variety of suitable shapes, sizes, configurations, and arrangements. It will also be understood that the liquid dispensing containers can include any suitable number of parts and components, such as containers, valve assemblies, lids, straws, and the like; and the liquid dispensing containers may include any appropriate number and combination of features, parts, aspects, and the like. In addition, while the liquid dispensing containers are illustrated in the accompanying figures as having particular styles and configurations, it will be appreciated that the liquid dispensing containers may have other styles and configurations. Furthermore, the liquid dispensing containers may be successfully used in connection with other types of devices.

Additionally, to assist in the description of various exemplary embodiments of the liquid dispensing containers, words such as top, bottom, front, rear, sides, right, and left may be used to describe the accompanying figures which may be, but are not necessarily, drawn to scale. It will further be appreciated that the liquid dispensing containers may be disposed in a variety of desired positions or orientations, and used in numerous locations, environments, and arrangements. A detailed description of exemplary embodiments of the liquid dispensing containers now follows.

Figure 1:
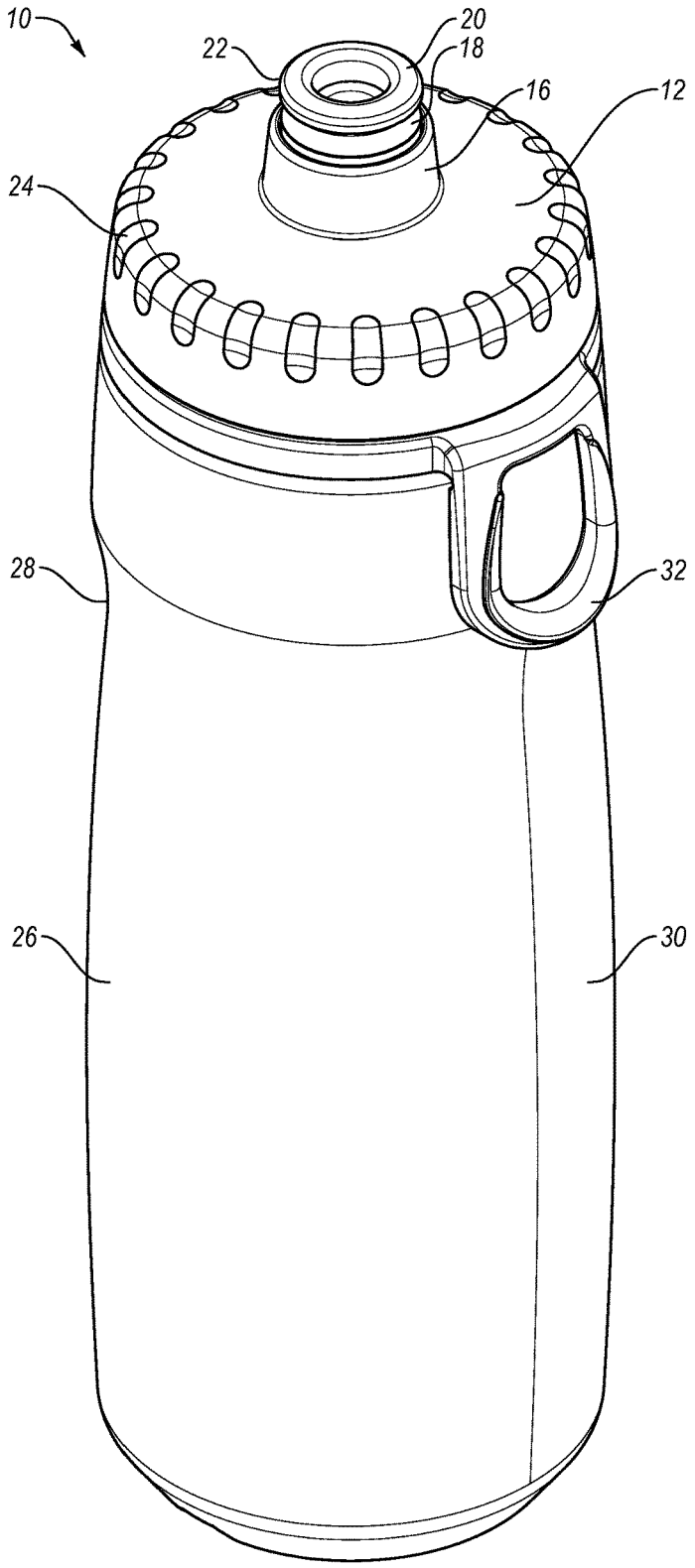
FIG. 1 is a perspective view of an exemplary container according to one or more embodiments of the invention.

FIG. 1 is a perspective view of an exemplary container 10 according to one or more embodiments of the invention. The container 10 may be a squeeze-type bottle in which fluids may be propelled from the container by squeezing the sides of the container. The container 10 may then resiliently return to its original configuration when pressure is no longer being applied. Thus, in one configuration or embodiment, the container 10 may be a water bottle. In another configuration or embodiment, a user may drink from the container 10 using a straw. Therefore, the container 10 may serve multiple purposes and may allow fluids to be easily and conveniently stored, transported and consumed.

As shown in the accompanying figures, the container 10 may include a lid 12 with an opening 14. The opening 14 may be surrounded by a raised surface, such as a flange 16, and a nozzle 18 may be at least partially disposed in the opening. The nozzle 18 may be designed to allow fluid to flow from the container 10. The nozzle 18 may include a distal end 20 and the end of the nozzle may be curved or beveled. The distal end 20 of the nozzle 18 may also include one or more gripping portions 22, such as flanges, protrusions, grooves and the like, which may facilitate grasping and/or moving the nozzle between one or more positions. For example, the gripping portion 22 may include an annular flange located at least proximate the distal end 20 of the nozzle 18 and the flange may aid in moving the nozzle between one or more positions. In particular, the nozzle 18 may be moved between first, second and third positions, and one or more of these positions may be a closed position. For instance, when the distal end 20 of the nozzle 18 is disposed at least proximate or adjacent the flange 16 surrounding the opening 14, the nozzle may be in the closed position. The distal end 20 of the nozzle 18 may move outwardly and away from the flange 16 surrounding the opening 14 and into a first open position in which the end of the nozzle is a first distance away from the flange. The distal end 20 of the nozzle 18 may also move outwardly and away a second distance away from the flange 16 and into a second open position. The three different positions of the nozzle 18 are in FIGS. 6A to 6C and are discussed in more detail below.

As shown in FIG. 1, the lid 12 may include one or more gripping members 24. The gripping members 24 may be any suitable combination of protrusions, projections, bumps, recesses, indentations, textured surfaces, and the like. The gripping members 24 may help a user grip the lid 12. The gripping members 24 may also facilitate attaching and/or removal of the lid 12 to a body 26 of the container 10. The body 26 may be sized and configured to hold liquids and fluids such as water, flavored water, sports drinks, beverages, gels, supplements, and the like. It will be appreciated that the body 26 of the container 10 may have various shapes, sizes, configurations and arrangements depending, for example, upon the intended use of the container.

As shown in the accompanying figures, the body 26 of the container 10 may have a generally cylindrical configuration and the top of the container may be tapered. The body 26 may include a recessed portion 28, such as groove or receiving channel, to facilitate holding the container 10. If desired, the body 26 may include one or more gripping portions 30, such as a textured surface, which may also facilitate holding the container 10. The gripping portions 30 may be at least partially disposed in the recessed portion 28, if desired. It will be appreciated that the recessed portions 28 and/or the gripping portions 30 may be any suitable combination of protrusions, projections, bumps, recesses, indentations, textured surfaces, and the like. The recessed and gripping portions 28, 30, however, are not required.

The body 26 may be sized and configured to allow the container 10 to be used in connection with various items such as bicycle water bottle cages, cup holders, and the like. The container 10 may include a carrying member 32, such as a handle. The carrying member 32 may have a generally loop-shaped configuration which may allow the container 10 to be easily and conveniently carried. The carrying member 32 may also allow the container 10 to be easily connected to other structures such as by a clip, line, fastener, and the like.

The container 10 may be constructed from durable, long-lasting materials. The container 10 may also be constructed from materials that allow it to be reused and/or recycled. For example, the lid 12 may be constructed from a relatively rigid material such as plastic. In particular, the lid 12 may be constructed from materials such as high-density polyethylene (HDPE) or other materials with similar properties and/or characteristics. The body 26 may be constructed from a relatively flexible material that allows the bottle to be squeezed or deformed, and then resiliently return to its original position. For instance, the body 26 may be constructed from low-density polyethylene (LDPE) or other materials with similar properties and/or characteristics. In view of this disclosure, one of ordinary skill in the art will appreciate that the container 10 and it various parts, such as the lid 12 and body 26, may be constructed from various materials with desired properties such as different types of plastics, glass, metal, composites and the like. Additionally, the lid 12 and/or body 26 may be constructed from at least partially transparent or translucent materials, which may allow the user to see the type and amount of fluids in the container 10. Further, the carrying member 32 may be constructed from a relatively durable material, such as plastic, and the carrying member may be flexible to allow it to be disposed in a variety of positions and locations. As discussed below, the carrying member 32 may be attached to the container 10 by a retaining member, such as a ring, and the retaining member may be disposed between the lid 12 and the body 26. It will be appreciated that the carrying member 32 may be attached to any suitable portion of the container 10 and the carrying member may be attached by other means, such as pivotally attaching the carrying member to the lid 12 or the body 26. The carrying member 32, however, is not required.

Figure 2:
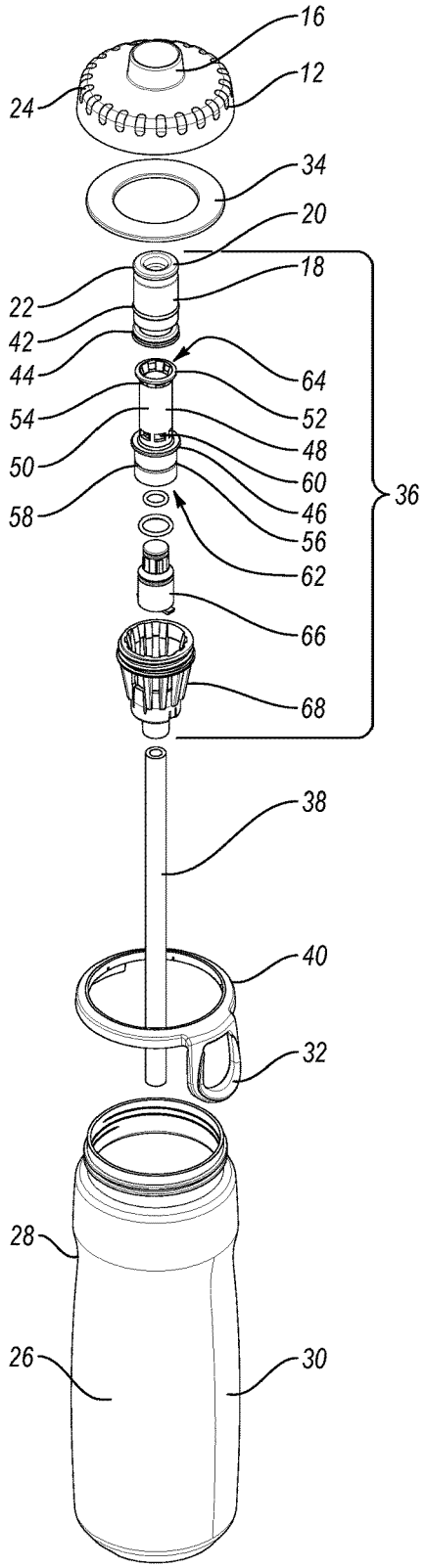
FIG. 2 is an exploded view of the container.

As shown in FIG. 2, the container 10 may include a lid gasket 34, a valve assembly 36, a straw 38, and a retaining member 40. The lid gasket 34 may help create a fluid-tight seal between the lid 12 and the body 26 of the container 10. The valve assembly 36 may help control the flow of fluid from the container 10. In particular, the valve assembly 36 may control whether fluid can flow from the container 10 and the valve assembly may control whether fluid flows through the straw 38 or through another passageway. Thus, the valve assembly 36 may not only determine if fluid can flow out of the container 10, but also the pathway the fluid may follow. The retaining member 40 may be used to couple the carrying member 32 to the container 10.

In greater detail, the valve assembly 36 may include the nozzle 18 and the nozzle may be movable within the opening 14 in the lid 12. The gripping portion 22 of the nozzle 18 may consist of an outwardly extending annular flange located at the distal end 20 and the nozzle may include a first receiving portion 42 and a second receiving portion 44. A seal, gasket or the like may be at least partially disposed in the first and/or second receiving portions, if desired. As shown in the accompanying figures, the nozzle 18 may have a generally cylindrical configuration and the nozzle may be sized and configured to fit within the generally circular opening 14 in the lid 12.

The valve assembly 36 may also include a conduit 48 with an elongated body 50 and an outwardly extending portion 52 with an uneven or irregular surface 54 may be disposed at one end of the body. The other end of the conduit 48 may include a base 56 and the base may have a larger diameter than the body 50. If desired, a tapered section and/or an engaging portion 46, such as an annular ring, may be disposed between the body 50 and the base 56 of the conduit 48. The base 56 may include a receiving portion 58, such as a groove or channel, and a plurality of openings 60 disposed at least proximate the base.

The conduit 48 is preferably hollow to allow fluid to flow through the conduit. In addition, fluid may flow into the conduit 48 through the openings 60, which may be formed in a sidewall of the body 50, and/or an opening 62 in the end of the conduit. Thus, fluid may enter the conduit 48 through one or more openings 60 and/or 62. Therefore, fluid may flow through two different pathways into the conduit 48. Fluid may exit the conduit 48 through an upper opening 64 of the conduit 48.

The valve assembly 36 may also include a straw cap 66 and a straw connector 68. As shown in the accompanying figures, the straw 38, the straw cap 66 and the straw connector 68 may be coupled or in fluid connection to allow fluid to flow through the straw and into the straw cap. The straw 38, the straw cap 66 and/or the straw connector 68 may be connected by a friction, interference or snap fit connection. The straw 38, the straw cap 66 and the straw connector 68 may also be connected by other suitable means and these components may be selectively connected for purposes such as assembly and/or cleaning. These and other components of the container 10 may also be integrally formed as part of a unity, one-piece structure if desired.

Figure 3:
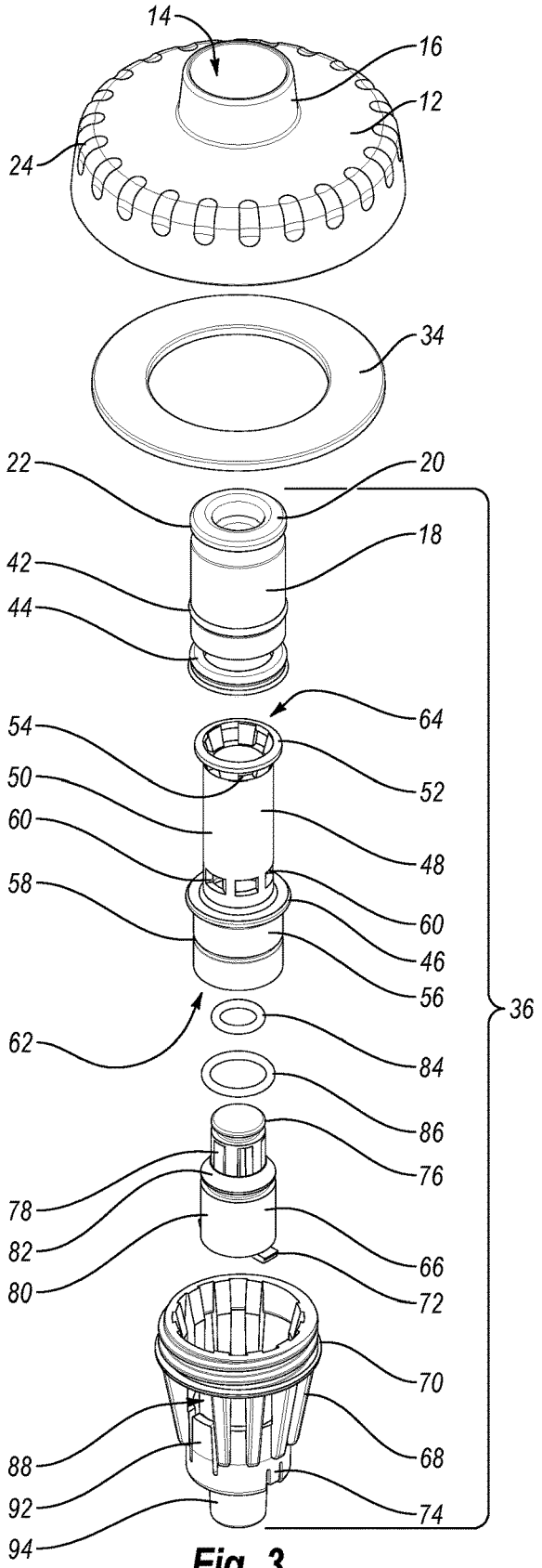
FIG. 3 is an enlarged, exploded view of a portion of the container shown in FIG. 2, illustrating an exemplary lid, lid gasket, and valve assembly.

In greater detail, as illustrated in FIG. 3, the lid gasket 34 may be disposed in the lid 12 and the lid gasket may help create a fluid-tight seal between the lid and the body 26 of the container 10. In addition, the nozzle 18 may be at least partially disposed in the opening 14 in the lid 12 and the upper portion of the conduit 48 may be disposed inside the nozzle. The nozzle 18 may be coupled to the conduit 48 such that the nozzle and the conduit may move together. For example, the nozzle 18 may be constructed from plastic and it may be over-molded onto at least a portion of the conduit 48. In particular, the nozzle 18 may be over-molded onto the upper portion of the conduit 48. In this embodiment, as the nozzle 18 moves up and down relative to the opening 14 in the lid 12, the conduit 48 may also move up and down. As described in more detail below, the movement of the nozzle 18 and conduit 48 may create different pathways through which fluid may flow through the valve assembly 36. It will be appreciated by one of ordinary skill in the art, after viewing this disclosure, that the nozzle 18 and conduit 48 may be coupled and/or interconnected in a variety of suitable configurations and arrangements. It will also be appreciated by one of ordinary skill in the art, after viewing this disclosure, that the nozzle 18 and conduit 48 could be a unitary, one-piece structure or different structures that do not have to be coupled or interconnected.

The straw cap 66 and the straw connector 68 may remain in a generally fixed position relative to the lid 12. For example, the straw connector 68 may be coupled to the lid 12 by one or more threads 70. In addition, the straw cap 66 may be coupled to the straw connector 68 by a connecting member 72 such as a tab, protrusion, projection, fastener, and the like. For example, the connecting member 72 may be disposed within a receiving portion 74 in the straw connector 68 to couple the straw cap and the straw connector. The connecting member 72 and the receiving portion 74 may be connected by friction, interference or snap fit connection. After reviewing this disclosure, one of ordinary skill in the art will appreciate that the various components of the valve assembly 36 may be coupled and connected using other appropriate structures, connectors and the like.

In greater detail, the straw cap 66 may include an upper portion 76 that may be at least partially disposed within the base 56 of the conduit 48. As seen in FIG. 3, the upper portion 76 of the straw cap 66 may include a plurality of openings 78 and a lower portion 80 of the straw cap may have a larger diameter than the upper portion. An angled or tapered surface 82 may connect the upper and lower portions 76, 80 of the straw cap 66. The lower portion 80 of the straw cap 66 may include a hollow interior portion that is in fluid communication with the openings 78 in the upper portion 76 of the straw cap. The straw cap 66 may also include one or more gaskets or seals. For example, a first gasket or seal 84 may be disposed at least proximate the upper portion 76 of the straw cap 66 and a second gasket or seal 86 may be disposed at least proximate the angled surface 82.

The straw connector 68 may include one or more openings that allow fluid to flow into the straw connector. For example, the straw connector 68 may include a first plurality of openings 88 and the first plurality of openings may allow a large volume of fluid to enter the straw connector. The straw connector 68 may also include a second plurality of openings 90 and these openings, for example, may allow additional fluid to flow into the straw connector and/or allow fluid to drain. Advantageously, the first and/or second plurality of openings 88, 90 may allow a large volume of fluid to flow through the straw connector 68. The straw connector 68 may also include a guide or positioning member 92, which may be designed to help position the valve assembly 36 in a desired position. The straw connector 68 may further include an end 94 that is configured to be coupled to the straw 38. The straw 38 may be selectively coupled to the straw connector 68, which may facilitate assembly and/or cleaning of the container 10.

As discussed above, the valve assembly 36 may include a number of gaskets or seals, such as the first and second gaskets 84, 86, which may help create a leak-proof and/or fluid-tight seal. The valve assembly 36 may also include additional gaskets or seals to help create a leak-proof and/or fluid-tight structure. Additionally, one or more gaskets or seals may be used to help create the desired fluid passageways.

Figure 6A:
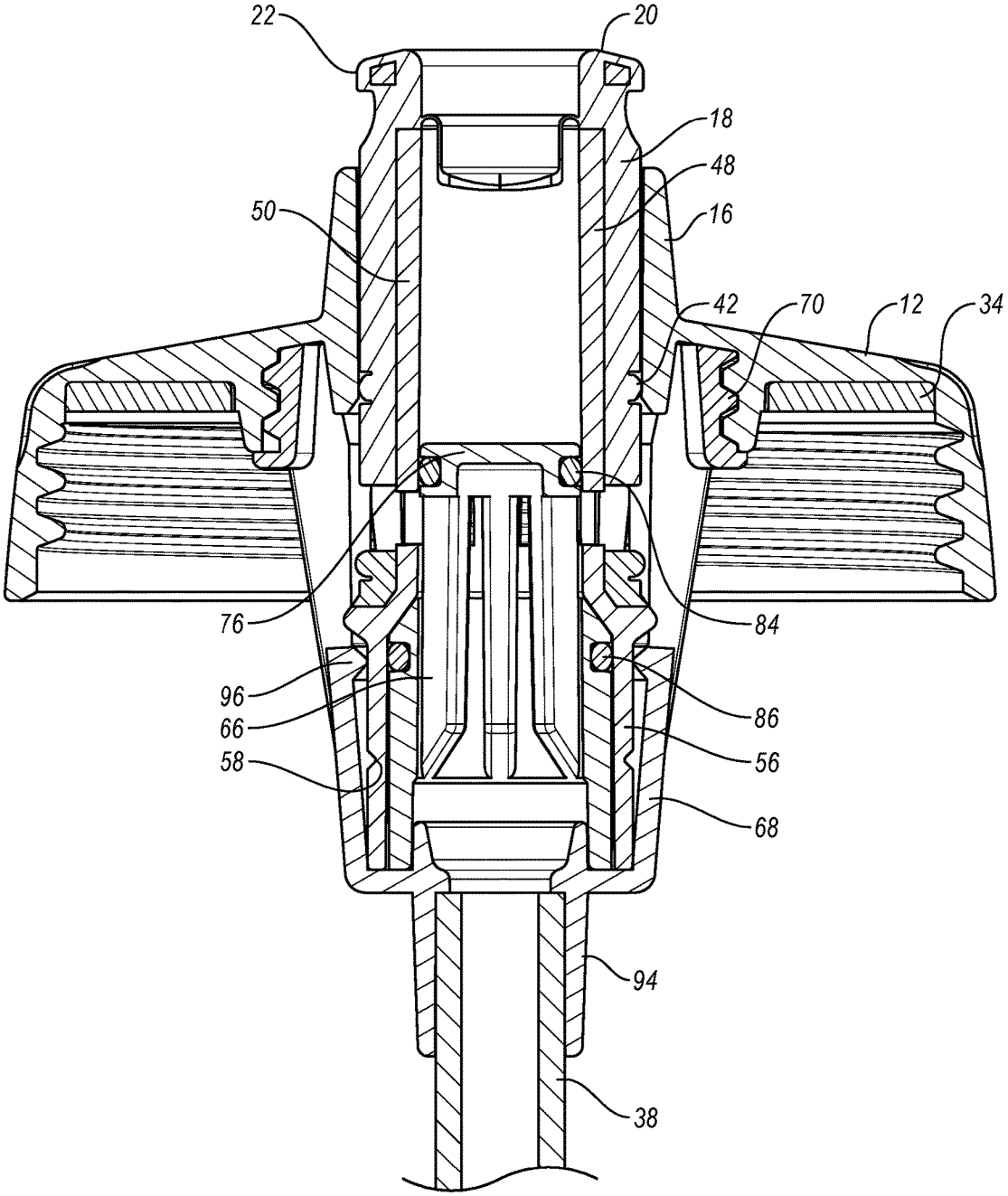
FIG. 6A is an enlarged, partial cutaway side view of an exemplary valve assembly, illustrating the valve assembly in a closed position.
Figure 6B:
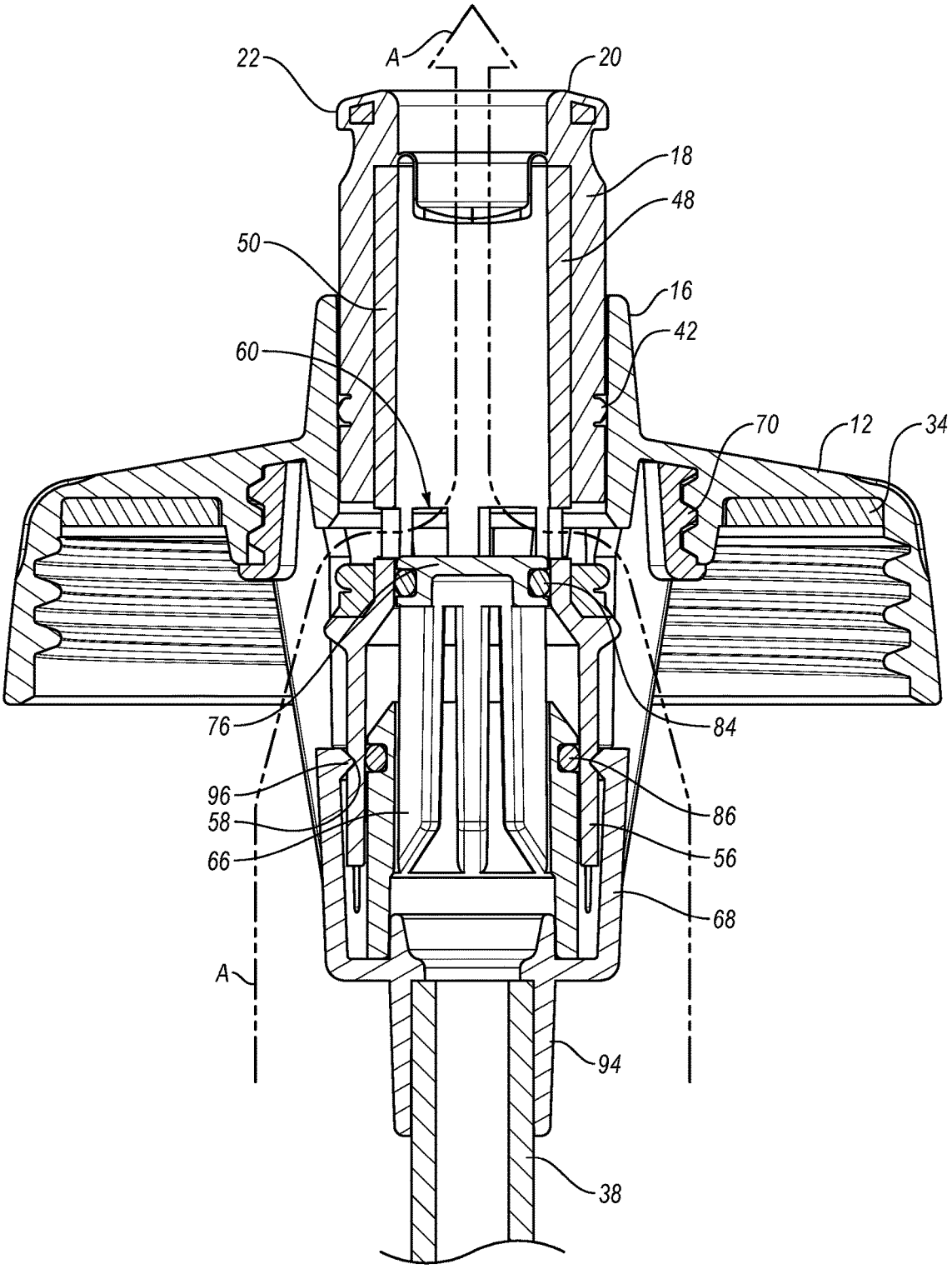
FIG. 6B is an enlarged, partial cutaway, side view of the exemplary valve assembly, illustrating the valve assembly in a first open position.
Figure 6C:
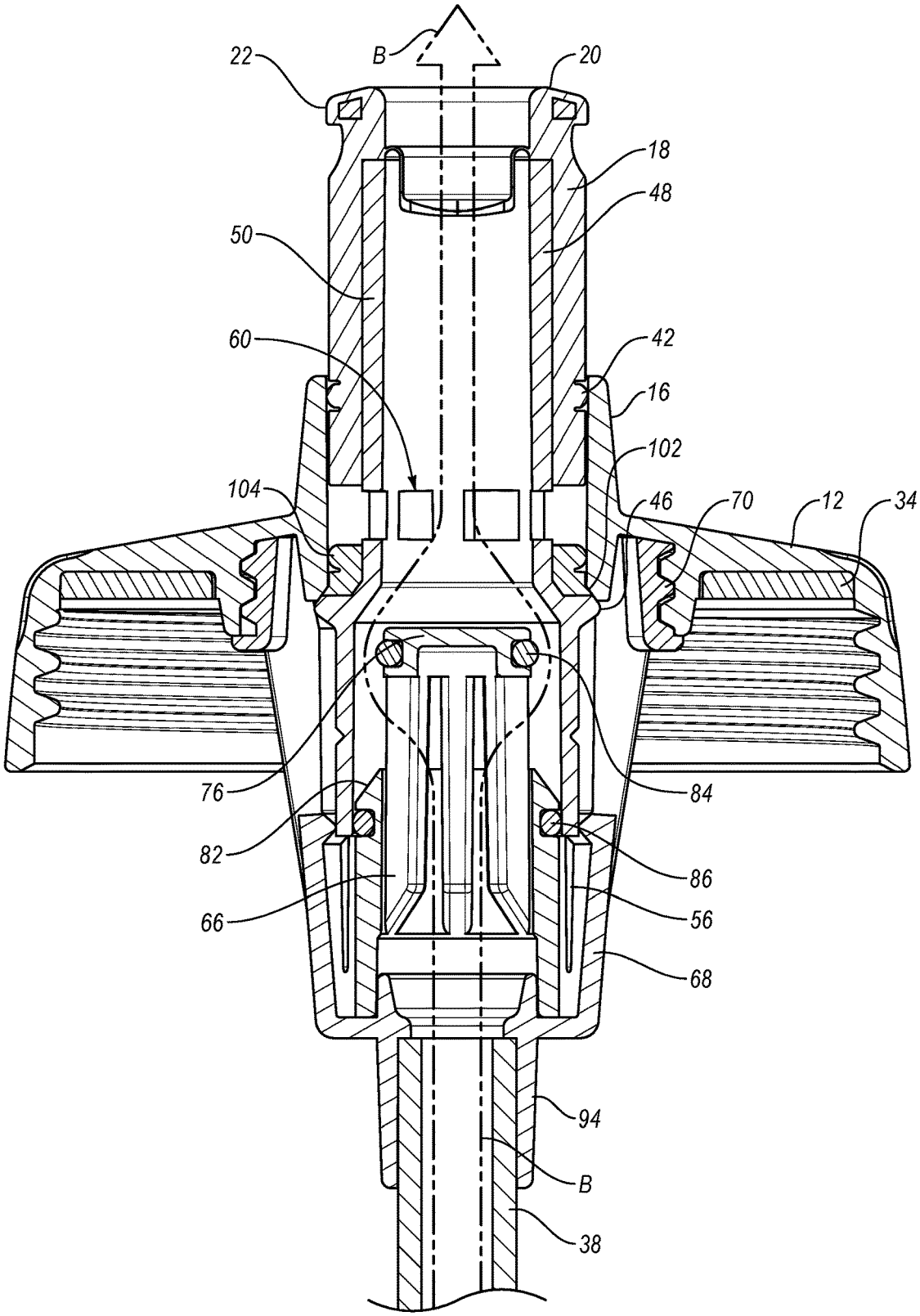
FIG. 6C is an enlarged, partial cutaway side view of the exemplary valve assembly in a second open position.

The valve assembly 36 may prevent fluid from flowing through the nozzle 18. The valve assembly 36 may also allow fluid to flow through a first passageway and through the nozzle 18. In addition, the valve assembly 36 may allow fluid to flow through a second passageway and through the nozzle 18. For example, as shown in FIG. 6A, when the valve assembly 36 is in the closed position, the positioning of the conduit 48 relative to the straw cap 66 may prevent fluid from flowing into the nozzle 18. In particular, the upper portion 76 of the straw cap 66 and the first seal 84 may be disposed in the body 50 of the conduit 48 and that may prevent fluid from entering the upper portion of the conduit. Because the upper portion 76 of the straw cap 66 and the first seal 84 may block fluid flow into the body 50 of the conduit 48, fluid may not enter the nozzle 18. As shown in FIG. 6B, when the valve assembly 36 is in the first open position, the upper portion 76 of the straw cap 66 and the first seal 84 may prevent fluid flow through the straw cap 66 and into the conduit 48. The valve assembly 36, however, may allow fluid flow through the openings 60 in the sidewall of the body 50 of the conduit 48. The first fluid passage way is illustrated in broken lines in A-A in FIG. 6B. As shown in FIG. 6C, when the valve assembly 36 is in the second open position, fluid may flow through a second passageway. The second passageway may allow fluid flow through the straw 38 and the straw cap 66. The second seal 86 may help prevent fluid flow between the conduit 48 and the straw cap 66. It will be appreciated that the seals 84, 86 may be any suitable type of seal such as O-rings, gaskets and the like. The second fluid passageway is illustrated by broken lines B-B in FIG. 6C.

Figure 4:
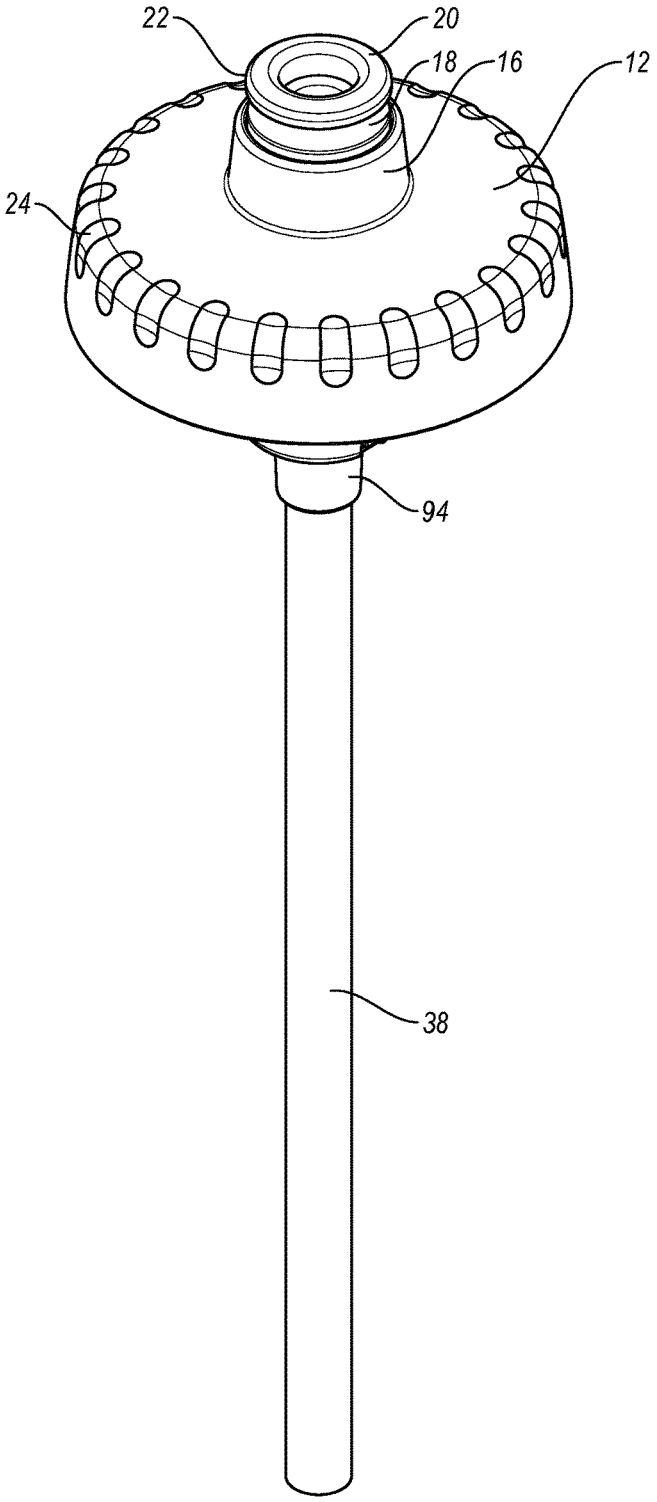
FIG. 4 is an enlarged upper perspective view of a portion of the container shown in FIG. 2, illustrating an exemplary lid, valve assembly, and straw.
Figure 5:
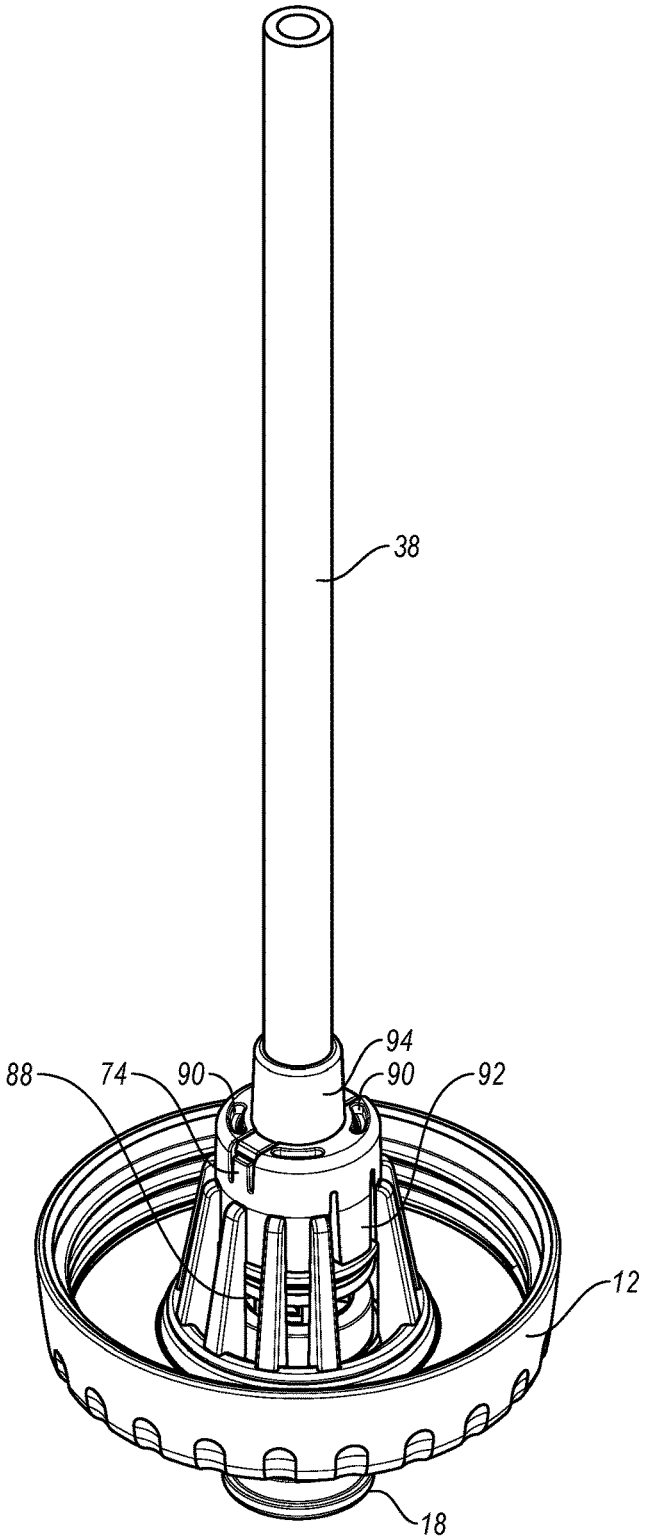
FIG. 5 is an enlarged, lower perspective view of a portion of the container shown in FIG. 2, illustrating an exemplary lid, valve assembly, and straw.

As shown in FIGS. 4 and 5, the lid 12, the valve assembly 36 and the straw 38 may be connected. In addition, the opening 14 in the lid 12, the nozzle 18, the straw 38, the straw cap 66, and the straw connector 68 may be generally aligned along a central axis. The opening 14 in the lid 12, the nozzle 18, the straw 38, the straw cap 66, and the straw connector 68, however, could be disposed at one or more angles depending, for example, upon the intended use of the container 10.

When the container 10 is used, the nozzle 18 may be moved between the closed and open positions. In particular, the nozzle 18 may be moved between the closed position shown in FIG. 6A, the first open position as shown in FIG. 6B, and the second open position as shown in FIG. 6C. Advantageously, when the nozzle 18 is moved, the conduit 48 may also move and the positioning of the nozzle and conduit may control fluid flow through the nozzle. That is, positioning of the nozzle 18 may determine whether or not fluid will flow through the nozzle. The positioning of the nozzle 18 may also control the pathway that fluid can flow through the valve assembly 36, and that may determine whether fluids can be sucked and/or squeezed through the straw 38 or whether fluids can be poured or squeezed out through the nozzle 18 when the container 10 is inverted.

In greater detail, in the closed position illustrated in FIG. 6A, the upper portion 76 of the straw cap 66 and the seal 84 may prevent fluid from entering the elongated body 50 of the conduit 48. In this configuration, the lower portion of the nozzle 18 and the lower portion of the body 50 of the conduit 48 may be generally aligned, and the upper portion 76 of the straw cap 66 may be disposed in the lower portion of the body 50 to prevent fluid from entering the conduit 48. If fluid cannot enter the body 50 of the conduit 48, fluid cannot flow through the nozzle 18. In the closed position, the base 56 of the conduit 48 may contact or abut the straw connector 68 and the distal end 20 of the nozzle 18 may be disposed at least proximate the flange 16 surrounding the opening 14 in the lid 12.

In the first open position, illustrated in FIG. 6B, the nozzle 18 and the conduit 48 may be moved upwardly such that the receiving portion 58 is aligned with and receives an engaging portion 96 of the guide member 92 of the straw connector 68. When the engaging portion 96 is disposed in the receiving portion 58, the nozzle 18 may be disposed in the first open position. In the first open position, the distal end 20 of the nozzle 18 may be disposed a first distance from the flange 16 and the base 56 of the conduit 48 may be spaced apart from the straw connector 68 by a distance. A first fluid passageway may be created to allow fluid to flow through the nozzle 18. In this embodiment, fluid may not flow through the straw 38 or the straw cap 66. Instead, fluid may flow directly through the openings 60 in the sidewall of the body 50 and into the conduit 48 to the nozzle 18.

In greater detail, fluid may flow through the first plurality of openings 88 in the straw connector 68 and into the plurality of openings 60 in the conduit 48 when the valve assembly 36 is in the first open position. This may allow, for example, fluid to flow from the body 26, through the openings 88 in the straw connector 68 and into the openings 60 in the conduit 48. Fluid can then flow through the body 50 of the conduit 48 and out the nozzle 18. Advantageously, when the valve assembly 36 is in the first open position, the body 26 of the container 10 may be squeezed and that may force fluid through the first passageway created by the openings 88 in the straw connector 68, the openings 60 in the conduit 48, the body 50 of the conduit and the nozzle 18. This may allow the container 10 to function as a water bottle, for instance, because when the container is inverted and/or squeezed, fluid may flow from the body 26 directly into the conduit 48 and out of the nozzle 18. In addition, particularly if the container 10 is at least substantially filled, fluid may be squirted out by squeezing the container and causing fluid to flow through the first passageway.

In the first open position, the upper portion 76 of the straw cap 66 and the first seal 84 may prevent fluid flow between the straw cap 66 and the conduit 48, which may prevent fluid from leaking into the straw cap. Additionally, the seal 42 may help prevent fluid flow between the flange 16 of the lid 12 and the nozzle 18. Thus, in the first open position, fluid may only flow through the openings 60 in the body 50 of the conduit 48 and out the nozzle, and fluid may not flow through the straw 38 or the straw cap 66.

In the second open position, illustrated in FIG. 6C, the nozzle 18 and the conduit 48 may be positioned such that the annular flange 46 abuts, contacts and/or engages an interior portion 102. The interior portion 102 may be part of the nozzle 18 and/or the lid 12. When the annular flange 46 of the conduit 48 abuts, contacts and/or engages the interior portion 102 of the lid 12, any further outward movement of the nozzle 18 and the conduit 48 may be prevented. When the annular flange 46 abuts, contacts and/or engages the interior portion 102 of the lid 12, a fluid-tight seal may be created. In the second open position, the openings 60 in the conduit 48 may be no longer aligned or be in fluid communication with the openings 88 in the straw connector 68. Thus, fluid may not be able to flow from the body 26 of the container 10 and through the openings 88 in the straw connector 68 to the openings 60 in the body 50 of the conduit 48. Fluid may be able to flow, however, through a second passageway created by the straw 38 and the straw cap 66. Specifically, fluid may flow through the straw 38, the lower portion 80 of the straw cap 66, the openings 78 in the straw cap, the opening 62 in the bottom of the conduit 48, the body 50 of the conduit, and the nozzle 18. Therefore, when a user sucks on the nozzle 18 or squeezes the container 26, fluid may flow through the straw 38 and into the straw cap 66. The fluid may then travel out of the openings 78 in the straw cap 66, into the opening 62 in the lower portion of the conduit 48, through the conduit 48 and out the nozzle 18.

When it is desired to use the container 10, the lid 12 may be removed from the body 26 and the container may be easily filled with fluids such as water, sports drinks, and the like. The lid 12 may then be connected to the body 26 by any type of suitable connection, such as a threaded connection. When the nozzle 18 is in the closed position, no fluid may flow through the nozzle. If a user desires to use the container 10 as a water bottle, the nozzle 18 may be moved into the first open position and the container may be inverted to allow fluid to be squeezed out of the container. In this position, fluid may also flow out of the container 10 under the force of gravity. In addition, in this first position, fluid may be squirted out of the container. If a user desires to drink from the container 10 using the straw 38, the nozzle 18 may be moved into the second open position and the user may suck on the nozzle which causes fluid to flow through the straw 38 and into the passageway created by the straw cap 66 and the opening 62 in the lower portion of the conduit 48. When the nozzle is in the second open position, the container 10 can also be squeezed to cause fluid to flow through the straw 38. Significantly, the different passageways may allow the container 10 to be used in upright and inverted positions, and may allow the container to be used as a water bottle or a bottle with a straw 38.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A liquid dispensing container comprising:

a body comprising a reservoir configured to hold a liquid;

a lid attached to the body; and a valve assembly comprising a conduit, the conduit movable relative to the lid between a closed position, a first open position and a second open position;

wherein:

when the conduit is in the closed position, the valve assembly inhibits fluid flow through the conduit;

when the conduit is in the first open position, a first passageway for the liquid extends from the reservoir through a first opening in the conduit; and when the conduit is in the second open position, a second passageway for the liquid extends from the reservoir through a second opening in the conduit.

2. The liquid dispensing container as in claim 1, wherein the conduit moves linearly between the closed position, the first open position, and the second open position.

3. The liquid dispensing container as in claim 1, wherein:

when the conduit is in the closed position, fluid cannot flow through the first passageway or the second passageway;

when the conduit is in the first open position, fluid cannot flow through the second passageway; and when the conduit is in the second open position, fluid cannot flow through the first passageway.

4. The liquid dispensing container as in claim 1, wherein:

the valve assembly further comprises a nozzle coupled to the conduit, the nozzle movable with the conduit; and movement of the nozzle relative to the lid moves the conduit relative to the lid.

5. The liquid dispensing container as in claim 1, wherein positioning of the conduit determines whether fluid can flow through the first passageway and/or the second passageway.

6. The liquid dispensing container as in claim 1, wherein the first opening in the conduit is disposed in a sidewall of the conduit and the second opening in the conduit is disposed in an end of the conduit.

7. The liquid dispensing container as in claim 1, further comprising a straw connector coupled to the lid, a straw cap at least partially disposed within the straw connector, and a straw coupled to the straw connector, wherein:

fluid flow through the straw or straw cap is inhibited when the conduit is in the first open position; and fluid flow through the straw and the straw cap is permitted when the conduit is in the second open position.

8. The liquid dispensing container as in claim 1, further comprising a straw connector coupled to the lid and a straw cap at least partially disposed within the straw connector, wherein movement of the conduit relative to the straw cap inhibits fluid flow through the conduit, allows fluid flow through the first passageway or allows fluid flow though the second passageway.

9. The liquid dispensing container as in claim 1, wherein:

the valve assembly further comprises a nozzle coupled to the conduit;

the nozzle moves together with the conduit outwardly and away a first distance from a flange surrounding the opening in the lid into the first open position; and the nozzle moves together with the conduit outwardly and away a second distance from the flange surrounding the opening in the lid into the second open position.

10. The liquid dispensing container as in claim 9, wherein the first distance is shorter than the second distance.

11. The liquid dispensing container as in claim 9, wherein an annular flange of the conduit engages an interior portion of the lid to inhibit further outward movement of the nozzle and the conduit when the valve assembly is in the second open position.

12. The liquid dispensing container as in claim 1, wherein:

the valve assembly further comprises an engaging portion; and a receiving portion of the conduit aligns with and receives the engaging portion of the valve assembly when the conduit is in the first open position.

13. The liquid dispensing container of claim 1, wherein the valve assembly further includes a nozzle coupled to the conduit and movable within an opening in the lid, the nozzle movable together with the conduit relative to the lid between the closed position, the first open position, and the second open position.

14. The liquid dispensing container of claim 13, wherein a first portion of the nozzle is disposed outside of both the body and the lid in the closed position, the first open position, and the second open position and a second portion of the nozzle is disposed within the opening in the lid in the closed position, the first open position, and the second open position.

15. The liquid dispensing container of claim 13, wherein the nozzle is movable together with the conduit between the closed position, the first open position, and the second open position in response to manipulation of the nozzle with a user's fingers or mouth.

16. A liquid dispensing container comprising:

a body comprising a reservoir configured to hold a fluid;

a lid attached to the body; and a valve assembly movable between a closed position, a first open position and a second open position;

wherein:

when the valve assembly is in the closed position, the valve assembly inhibits fluid from being discharged from the reservoir of the body;

when the valve assembly is in the first open position, a first passageway for the fluid extends from the reservoir and allows the fluid to be discharged from the reservoir of the body by inverting and/or squeezing the container without the fluid passing through a straw;

when the valve assembly is in the second open position, a second passageway for the fluid extends from the reservoir and allows the fluid to be discharged from the reservoir of the body by sucking and/or squeezing through the straw; and the first passageway and the second passageway share a common outlet that is included in both the first passageway and the second passageway.

17. The liquid dispensing container of claim 16, wherein:

when the valve assembly is in the closed position, the fluid cannot flow through the first passageway or the second passageway;

when the valve assembly is in the first open position, the fluid cannot flow through the second passageway; and when the valve assembly is in the second open position, the fluid cannot flow through the first passageway.

18. The liquid dispensing container of claim 16, wherein the valve assembly includes a nozzle movable within an opening in the lid, the nozzle movable relative to the lid between the closed position, the first open position, and the second open position.

19. The liquid dispensing container of claim 18, wherein a portion of the nozzle is disposed outside of both the body and the lid.

20. The liquid dispensing container of claim 18, wherein the nozzle is movable between the closed position, the first open position, and the second open position in response to manipulation of the nozzle with a user's fingers or mouth.

* * * * *